US011808244B2

(12) United States Patent
Von Gaisberg-Helfenberg et al.

(10) Patent No.: US 11,808,244 B2
(45) Date of Patent: Nov. 7, 2023

(54) INTERNAL COMBUSTION ENGINE FOR A MOTOR VEHICLE, IN PARTICULAR FOR A CAR

(71) Applicant: Mercedes-Benz Group AG, Stuttgart (DE)

(72) Inventors: Alexander Von Gaisberg-Helfenberg, Beilstein (DE); Thomas Stolk, Kirchheim (DE)

(73) Assignee: Mercedes-Benz Group AG, Stuttgart (DE)

( * ) Notice: Subject to any disclaimer, the term of this patent is extended or adjusted under 35 U.S.C. 154(b) by 0 days.

(21) Appl. No.: 17/802,393

(22) PCT Filed: Jan. 28, 2021

(86) PCT No.: PCT/EP2021/051902
§ 371 (c)(1),
(2) Date: Aug. 25, 2022

(87) PCT Pub. No.: WO2021/170334
PCT Pub. Date: Sep. 2, 2021

(65) Prior Publication Data

US 2023/0167795 A1 Jun. 1, 2023

(30) Foreign Application Priority Data

Feb. 26, 2020 (DE) ..... 10 2020 001 260.4

(51) Int. Cl.
*F02N 5/02* (2006.01)
*F02N 5/04* (2006.01)
*F02N 15/02* (2006.01)

(52) U.S. Cl.
CPC ..... *F02N 5/02* (2013.01); *F02N 5/04* (2013.01); *F02N 15/022* (2013.01); *F02N 2200/022* (2013.01)

(58) Field of Classification Search
CPC . F02N 5/02; F02N 5/04; F02N 15/022; F02N 2200/022; F02B 67/04
See application file for complete search history.

(56) References Cited

U.S. PATENT DOCUMENTS 6,622,683 B2 * 9/2003 Gracyalny ..... F02N 5/02 123/185.3
6,647,942 B2 * 11/2003 Poehlman ..... A01D 34/6818 123/185.3

(Continued)

FOREIGN PATENT DOCUMENTS

DE 145937 C 12/1903
DE 10 2009 001 317 A1 9/2010

(Continued)

OTHER PUBLICATIONS

PCT/EP2021/051902, International Search Report dated May 7, 2021 (Two (2) pages).

(Continued)

*Primary Examiner* — Phutthiwat Wongwian
*Assistant Examiner* — Arnold Castro
(74) *Attorney, Agent, or Firm* — Crowell & Moring LLP

(57) ABSTRACT

An internal combustion engine of a motor vehicle includes an output shaft and a spring element which can rotate with the output shaft which is to be tensioned as a result of a deactivation of the internal combustion engine by a rotation of the output shaft, where a spring force can be provided by the spring element and where by the spring force the output shaft can be set into rotation in the event of a start following the deactivation. Via a locking device the output shaft is to be secured against a rotation after tensioning the spring element and while the spring element is tensioned. A blocking device can be shifted between a blocking state securing a first part of the spring element, which has a second part (Continued)

non-rotationally connected to the output shaft, against a rotation and a release state releasing the first part for a rotation.

3 Claims, 1 Drawing Sheet

(56) References Cited

U.S. PATENT DOCUMENTS

| | | | | |
|---|---|---|---|---|
| 7,107,960 | B1 * | 9/2006 | Ursu | F02N 5/02 290/1 E |
| 7,886,709 | B2 | 2/2011 | Riedel et al. | |
| 2006/0102138 | A1 | 5/2006 | Steiner et al. | |

FOREIGN PATENT DOCUMENTS

| | | | |
|---|---|---|---|
| DE | 10 2019 000 999 | A1 | 8/2019 |
| EP | 1 672 198 | A1 | 6/2006 |

OTHER PUBLICATIONS

German-language German Office Action issued in German application No. 10 2020 001 260.4 dated May 19, 2020 (Six (6) pages).

* cited by examiner

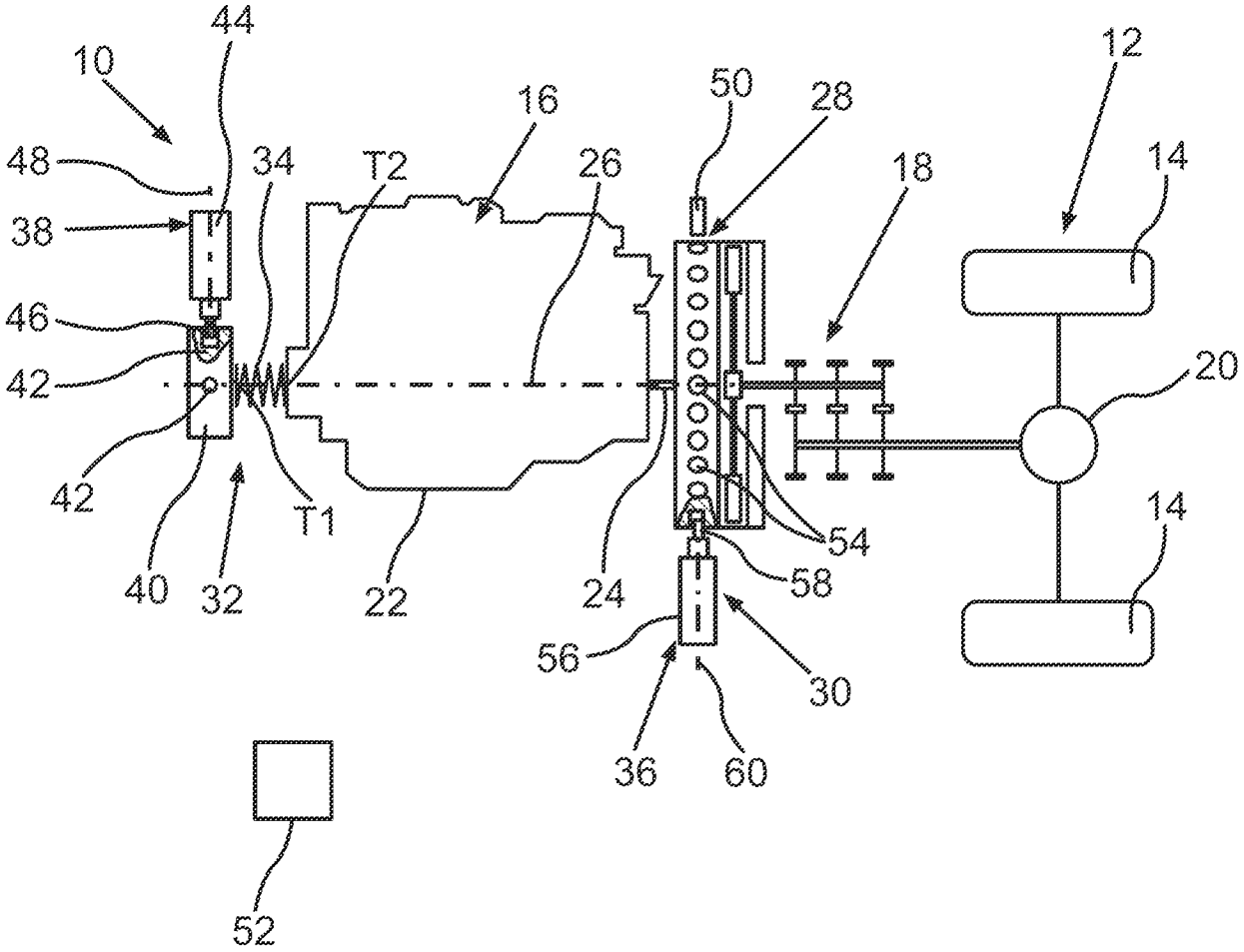
12
14
20
14
18
28
54
58
30
50
60
36
56
24
26
16
22
T2
T1
34
44
32
52
10
48
38
46
42
42
40

INTERNAL COMBUSTION ENGINE FOR A MOTOR VEHICLE, IN PARTICULAR FOR A CAR

BACKGROUND AND SUMMARY OF THE INVENTION

The invention relates to an internal combustion engine for a motor vehicle, in particular for a car.

DE 10 2009 001 317 A1 describes a device for starting an internal combustion engine. Here, an energy accumulator is provided which stores the remaining rotational energy of the internal combustion engine when it is switched off and releases it when it is restarted to rotate the crankshaft in the opposite direction. Furthermore, EP 1 672 198 A1 discloses an internal combustion engine with a crankshaft and a flywheel that is arranged on the crankshaft and is constructed modularly from at least two flywheel segments.

The object of the present invention is to create an internal combustion engine for a motor vehicle, such that particularly advantageous operation of the internal combustion engine can be implemented.

A first aspect of the invention relates to an internal combustion engine for a motor vehicle, in particular for a car, such as a passenger car, for example. The internal combustion engine, for example formed as a reciprocating piston engine, has an output shaft, for example in the form of a crankshaft, which can be rotated around an axis of rotation relative to a housing of the internal combustion engine. The internal combustion engine can also comprise the housing, which can be a crank housing, in particular a cylinder crank housing, for example. The internal combustion engine can provide torques for driving the motor vehicle via the output shaft.

The internal combustion engine also has at least one spring element that can rotate with the output shaft. For this purpose, the spring element, in particular at least a part of the spring element or an end of the spring element, is non-rotationally connected to the output shaft. For example, the spring element is designed as a torsion or rotation spring. The spring element is to be tensioned during a run-down of the output shaft resulting from a deactivation of the initially activated internal combustion engine by a rotation of the output shaft taking place in the run-down and relative to the housing around the axis of rotation. The aforementioned run-down of the output shaft is to be understood in particular as follows: For example, if the internal combustion engine is initially activated, the internal combustion engine is initially in its fired operation. In the fired operation, combustion processes take place in the internal combustion engine, in particular in at least one combustion chamber of the internal combustion engine, by means of which the output shaft is driven and thereby rotated around the axis of rotation relative to the housing element. The aforementioned deactivation of the internal combustion engine is also referred to as disabling, stopping or switching off the internal combustion engine. By deactivating the internal combustion engine, which is initially activated and thus in its fired operation, the fired operation is terminated, in particular by terminating a supply of fuel into the combustion chamber and/or an ignition in the combustion chamber, resulting in a cessation of combustion processes in the combustion chamber. As a result, the output shaft is no longer driven by combustion processes taking place in the internal combustion engine, and the output shaft is also not driven in any other way, although the output shaft continues to rotate for a certain amount of time as a result of and despite the deactivation and in particular due to its mass inertia, i.e., it coasts down without being driven. Thus, during the coasting of the output shaft, the output shaft is not driven, and during the coasting, a rotational speed of the output shaft decreases. Since the output shaft rotates during its run-down, in particular due to its mass inertia, the output shaft has rotational energy. This rotational energy is used during the run-down to tension the spring element, which is also simply referred to as a spring, by means of the rotational energy. Thus, at least part of the rotational energy of the output shaft is converted into spring energy of the spring element or stored as spring energy by or in the spring element during run-out by tensioning the spring element.

By tensioning or as a result of tensioning the spring element, a spring force can be provided by means of the spring element. In other words, the spring element provides a spring force as a result of the tensioning of the spring element. By means of the spring force, during a start of the initially deactivated internal combustion engine following the aforementioned deactivation of the internal combustion engine, the output shaft can be set in rotation relative to the housing around the axis of rotation. In other words, if the internal combustion engine is started after its deactivation, which is also referred to as starting or the start of the internal combustion engine, the spring force which can be provided or is provided by the spring element is used during the start in order to rotate the output shaft by means of the spring force of the spring element and thereby to support or bring about the start of the internal combustion engine. This means in particular that the start of the internal combustion engine following deactivation is carried out with the aid of the rotation of the output shaft, the rotation of which is effected by means of the spring force.

Preferably, it is provided that, between the deactivation and the subsequent start of the internal combustion engine, a further start and deactivation of the internal combustion engine is omitted. Overall, it can be seen that the rotation of the output shaft that takes place during deceleration and thus the rotational energy of the output shaft contained in the output shaft during deceleration is used to rotate the output shaft during the subsequent start of the internal combustion engine and thus to start the internal combustion engine.

Here, the internal combustion engine also comprises a locking device which is designed in particular separately from the output shaft and separately from the spring element and is provided in addition thereto, by means of which the output shaft can be secured against rotation relative to the housing and the axis of rotation after the spring element has been tensioned by the rotation or rotational energy of the output shaft during coasting and while the spring element is tensioned. By means of the locking device, the output shaft can be secured against rotation around the axis of rotation relative to the housing as required, whereby the spring element can be kept tensioned as required after tensioning of the spring element. In addition, the locking device enables the output shaft to be released as required for rotation relative to the housing around the axis of rotation, whereby release of all or at least parts of the spring element can be enabled as required. In other words, if the output shaft is initially secured against rotation around the axis of rotation relative to the housing by means of the locking device, the spring element, for example, is kept tensioned. If the internal combustion engine is then to be started, the locking device releases the output shaft for rotation around the axis of rotation relative to the housing. As a result, the initially tensioned spring element can relax, whereby the output shaft can be set in rotation, i.e., rotated, by means of the spring force, in order to start the internal combustion engine at the start.

In order to now be able to implement a particularly advantageous operation of the internal combustion engine, the internal combustion engine comprises, according to the invention, a locking device which is provided in addition to the blocking device and is preferably formed separately from the blocking device, separately from the output shaft and separately from the spring element and is provided in addition thereto, and which can be adjusted between a locking state and a release state. For example, the blocking device can be operated hydraulically and/or pneumatically and/or electrically and can thus be adjusted hydraulically and/or pneumatically and/or electrically between the locking state and the release state. In the locking state, at least a first part of the spring element is secured by means of the blocking device against rotation relative to the housing around the axis of rotation, such that in the locking state at least the first part of the spring element cannot rotate around the axis of rotation relative to the housing. It is further provided that at least a second part of the spring element is connected to the output shaft in a rotationally fixed manner and is thus co-rotatable with the output shaft. In the release state, the locking device releases the first part of the spring element for rotation relative to the housing around the axis of rotation. For example, if the locking device releases the output shaft for rotation around the axis of rotation relative to the housing, while the locking device releases the first part for rotation around the axis of rotation relative to the housing, the output shaft can be rotated around the axis of rotation relative to the housing, in particular by combustion processes taking place in the internal combustion engine. Since the second part of the spring element is connected to the output shaft in a rotationally fixed manner, the second part of the spring element is rotated with the output shaft around the axis of rotation relative to the housing. Since the blocking device is in the release state, the first part can also rotate around the axis of rotation relative to the housing, such that the parts of the spring element, in particular the spring element as a whole, rotates or can rotate with the output shaft around the axis of rotation relative to the housing, in particular without the spring element being twisted or tensioned. In other words, the rotation of the output shaft around the axis of rotation relative to the housing is not excessively affected by the spring element, the blocking device and the locking device, because the output shaft and the spring element, in particular the entire spring element, can rotate together around the axis of rotation relative to the housing, for example, and relative to the blocking device and relative to the locking device. The aforementioned at least one part of the spring element is thus, for example, the second part.

If, for example, the blocking device is moved from its release state into its locking state during a or the run-down of the output shaft, in particular while the blocking device still releases the output shaft for rotation relative to the housing around the axis of rotation, the first part of the spring element is fixed or secured against rotation on the housing, in particular while the output shaft and, with it, the second part rotate around the axis of rotation, in particular in a first direction of rotation, relative to the housing and in particular relative to the first part. This causes the spring element to be twisted and thus tensioned. In the process, the output shaft is braked, in particular until it comes to a first standstill. In the first standstill of the output shaft, the spring element is tensioned such that—since the locking device is still open—the tensioned spring element then rotates the output shaft backwards from the first standstill, i.e., in a second direction of rotation opposite to the first direction of rotation, in particular until the spring element or at least parts thereof is or are relaxed. Due to its inertia, however, the output shaft continues to rotate in the second direction of rotation—in particular even though the spring element is relaxed—which causes the spring element to be tensioned again. This brakes the output shaft again, in particular until the output shaft reaches its second standstill. Then the spring element is tensioned again. At the second standstill or shortly thereafter or shortly before and in particular as long as the spring element is tensioned again, the locking device is closed, i.e., switched to its locked state. Then the spring element, which has been tensioned again, is kept tensioned. If the locking device is then moved from its locked state to its second released state, the spring element can relax so that the spring element or its spring force causes the output shaft to rotate in the first direction of rotation in order to start the internal combustion engine. Thus, the output shaft is accelerated or rotated in the correct, first direction of rotation for the start by means of the spring element.

In other words, if the output shaft is prevented from rotating around the axis of rotation relative to the housing by means of the locking device while the blocking device is still in the locked state, relative rotations between the parts of the spring element around the axis of rotation, for example, can be avoided or at least kept low, whereby the spring element can be kept taut. If the locking device then releases the output shaft for rotation around the axis of rotation relative to the housing, the parts of the spring element can rotate relative to one another around the axis of rotation or the spring element can relax and thereby drive the output shaft, i.e., rotate around the axis of rotation relative to the housing, in order thereby to start the internal combustion engine. Overall, it can be seen that the blocking device and the locking device enable a demand-oriented and thus particularly advantageous operation of the internal combustion engine, in particular with regard to the tensioning of the spring element, to the rotation of the output shaft moved by the spring force of the spring element and also to the fired operation of the internal combustion engine, since excessive impairments of the output shaft or its rotation can be avoided during fired operation.

Since the output shaft is rotated by means of the spring force of the spring element to start the internal combustion engine, an electric engine or starter engine can be avoided for starting the internal combustion engine, for example, or such a starter engine can be supported by means of the spring force, such that the starter engine can be designed to be particularly compact, lightweight and cost-effective. This means that the weight, the number of parts and the costs of the internal combustion engine can be kept low, such that particularly efficient operation can be achieved.

Since the run-down of the output shaft or the rotational energy contained in the output shaft during run-down of the output shaft is moreover used to tension the spring element, the spring force is already available at the beginning of the start of the internal combustion engine following deactivation in order to set the output shaft in rotation and thus to start the internal combustion engine. The internal combustion engine can thus be put into operation after its deactivation and at the subsequent start at least almost without delay, since the spring element does not have to be tensioned and thus charged only after the deactivation of the internal combustion engine and after the output shaft has come to a standstill and before the subsequent start. The run-down is also referred to as the engine run-out and is used to tension the spring element by means of the rotational energy of the output shaft. Thus, according to the invention, rotational energy is used to start the internal combustion engine, whereas this rotational energy would normally be lost unused. In particular, the rotational energy in the form of energy stored in the spring element or the spring force is used to accelerate the output shaft when the internal combustion engine is started and thus to set it in rotation. This makes it possible, for example, to avoid the need for space-, weight- and cost-intensive electric motors for starting the internal combustion engine.

Furthermore, a blocking element formed separately from the spring element and non-rotationally connected to the first part of the spring element is provided. In other words, the internal combustion engine comprises the blocking element with which the blocking device cooperates in the locked state. In doing so, the blocking element and, via this, the first part of the spring element, are to be secured against a following rotation relative to the housing around the axis of rotation or are secured in the locking state. The blocking element enables the first part of the spring element to be fixed and released in a targeted manner and as required, such that particularly advantageous operation of the internal combustion engine is possible.

In order to implement a particularly demand-oriented and thus advantageous operation of the internal combustion engine, it is provided that the locking device is adjustable between a second locking state securing the output shaft against rotation relative to the housing around the axis of rotation and a second release state releasing the output shaft for rotation relative to the housing around the axis of rotation.

The previous and following designs regarding the blocking device can also be readily transferred to the locking device and vice versa. It is thus conceivable that the locking device can be operated, for example, hydraulically and/or pneumatically and/or electrically.

Here, a flywheel is provided which is designed separately from the output shaft and can rotate together with the output shaft, with which the locking device cooperates in the second locking state, in particular positively. As a result, the output shaft can be secured against rotation by means of the locking device over a particularly large diameter—in relation to the axis of rotation—such that the locking device can be designed to be particularly compact, lightweight and cost-effective.

In order to realize a particularly advantageous operation of the internal combustion engine, it is provided that the flywheel and the blocking element are arranged on opposite sides of the output shaft in the axial direction of the output shaft.

In order, for example, to be able to secure the first part of the spring element or the output shaft particularly well against rotation relative to the housing, it is preferably provided that the locking device and/or the blocking device is held at least indirectly, in particular directly, on the housing, in particular in such a way that the locking device or the blocking device is secured against rotation around the axis of rotation relative to the housing.

Finally, it has proved to be particularly advantageous when the internal combustion engine has at least one sensor by means of which a rotational speed of the output shaft can be detected and an electrical signal characterizing the rotational speed of the output shaft detected by means of the sensor can be provided. The blocking device and/or the locking device can be operated as a function of the signal. In this way, the first part of the spring element and the output shaft can be secured and released as required, such that particularly advantageous operation can be achieved.

A second aspect relates to a method for starting an internal combustion engine for a motor vehicle, in particular an internal combustion engine according to the first aspect of the invention. In the methods, the internal combustion engine has an output shaft which is rotatable around an axis of rotation relative to a housing of the internal combustion engine and via which torques can be provided or are provided by the internal combustion engine for driving the motor vehicle.

In the method, a spring element which can rotate with the output shaft is tensioned during a run-down of the output shaft resulting from a deactivation of the initially activated internal combustion engine by a rotation of the output shaft taking place during the run-down and relative to the housing around the axis of rotation in a first direction of rotation until the output shaft comes to a first standstill or its first standstill as a result.

The output shaft is then driven out of the first standstill by means of the tensioned spring element, causing the output shaft to rotate around the axis of rotation relative to the housing in a second direction of rotation opposite to the first direction of rotation. The spring element is tensioned again by the rotation of the output shaft in the second direction of rotation, whereby the output shaft rotating in the second direction of rotation is braked, for example, in particular until the output shaft reaches its standstill or a second standstill. By means of a locking device, the output shaft is secured against rotation relative to the housing around the axis of rotation after the spring element has been tensioned again and while the spring element is tensioned again. As a result of the spring element being tensioned again, the spring element provides a spring force by means of which, as a result of the locking device releasing the output shaft for rotation relative to the housing around the axis of rotation, the output shaft is rotated relative to the housing around the axis of rotation in the first direction of rotation when the internal combustion engine is started following deactivation. Advantages and advantageous designs of the first aspect of the invention are to be regarded as advantages and advantageous designs of the second aspect, and vice versa.

In order to realize a particularly efficient and thus advantageous operation of the internal combustion engine, it is provided in an embodiment of the second aspect that the start of the internal combustion engine is carried out as a direct start, which is supported by the rotation of the output shaft caused by means of the spring force. The direct start is to be understood in particular as meaning that the internal combustion engine, which is initially deactivated, i.e., in a deactivated state, and whose output shaft, for example in the form of a crankshaft, is stationary during the deactivated state and during a standstill of the motor vehicle, for example, is started during the standstill of the motor vehicle, i.e., is transferred into an activated state and thus into its fired operation, without the output shaft being rotated by means of an electric motor, such as a starter or starter generator, during the standstill or travel of the motor vehicle in order to start the internal combustion engine. To start the internal combustion engine, its output shaft is rotated. This is done in the context of direct starting, without an electric motor and by rotating the output shaft by means of the spring force and injecting fuel, in particular liquid fuel, directly into a combustion chamber to operate the internal combustion engine in the fired mode, for example by means of an injector, and then igniting it, in particular in a fuel-air mixture comprising the fuel and air. By starting the internal combustion engine by direct starting, an electric motor for starting the internal combustion engine can be minimised or avoided, so that the space requirement, costs and weight of the internal combustion engine can be kept particularly low.

Alternatively, it has proved to be particularly advantageous if the output shaft is rotated by means of an electric machine provided in addition to the combustion engine. The electric machine is supported by the spring force during the rotation of the output shaft caused by the electric machine, such that the electric machine can be designed to be particularly compact, lightweight and cost-effective.

The direct start is, for example, a first way of starting the internal combustion engine, this first way also being referred to as the first start mode. A second type of start for starting the internal combustion engine is or comprises, for example, that the output shaft is rotated from outside the internal combustion engine, i.e., for example by means of the aforementioned electric machine, which is formed separately from the internal combustion engine and is provided in addition to the internal combustion engine, in particular while fuel is being introduced into the combustion chamber and ignitions are being carried out, in particular until the output shaft reaches or exceeds a starting speed with regard to its rotational speed or until the output shaft is driven by combustion processes taking place in the combustion chamber. By using the spring element, both types of starting can be carried out particularly advantageously, so that particularly advantageous operation can be realized.

The invention is based, in particular, on the following knowledge: Internal combustion engines can be started, i.e., put into operation, by direct starting. In this case, the output shaft, which is initially stationary, i.e., at a standstill, is to be set in rotation by firing at least one combustion chamber or cylinder of the internal combustion engine without the output shaft being driven by means of an electric engine. However, the power that can be provided by the igniter is often not sufficient, such that auxiliary systems are used. Examples of this, apart from electric engines, are so-called compressed air, hydraulic, flywheel, Coffman or Hucks starters. In contrast, the invention uses the spring described and designed, for example, as a torsion spring, by means of which rotational energy of the output shaft and/or the flywheel can be used to support the direct start or the second type of start. For this purpose, the rotational energy of the crankshaft or the flywheel is stored in the spring. As a result, the spring can accelerate the output shaft when the internal combustion engine is started. As a result, space-, weight- and cost-intensive electric engines for starting the internal combustion engine can be avoided. In particular, the invention enables a reliable, spring-assisted direct start.

Further advantages, features and details of the invention emerge from the following description of a preferred exemplary embodiment and from the drawing. The features and combinations of features mentioned in the description above and the features and combinations of features mentioned in the description of the FIGURE below and/or shown alone in the single FIGURE can be used not only in the respectively specified combination, but also in other combinations or on their own, without leaving the scope of the invention.

BRIEF DESCRIPTION OF THE DRAWING

In the single FIGURE, the drawing sectionally shows a schematic depiction of a drivetrain of a motor vehicle, wherein the drivetrain comprises an internal combustion engine according to the invention.

DETAILED DESCRIPTION OF THE DRAWING

The single FIGURE sectionally shows a schematic depiction of a drivetrain 10 of a motor vehicle designed in particular as a motor vehicle and preferably as a passenger car. This means that the motor vehicle in its fully manufactured state comprises the drivetrain 10. In addition, the motor vehicle in its fully manufactured state comprises, for example, at least or exactly two axles arranged one behind the other in the longitudinal direction of the vehicle, of which one axle labelled with 12 is shown in the FIGURE. The axle 12 comprises at least or exactly two vehicle wheels 14 spaced apart from each other in the transverse direction of the vehicle and simply also referred to as wheels. Moreover, the drivetrain 10 comprises an internal combustion engine 16 in the form of a reciprocating piston engine, by means of which the wheels 14 and thus the motor vehicle as a whole can be driven by an internal combustion engine via a transmission 18 of the drive train 10. The gearbox 18 is, for example, a change-speed gearbox and thus comprises several gears or gear steps which can be engaged and disengaged. The axle 12 comprises an axle gear 20, also referred to as a differential gear, via which the wheels 14 can be driven by the gearbox 18.

The internal combustion engine 16 has a housing 22, for example in the form of a crank housing, in particular a cylinder crank housing, and an output shaft 24, for example in the form of a crankshaft, which is mounted on the housing 22 so as to be rotatable around an axis of rotation 26 relative to the housing 22. Via or by means of the output shaft 24, the internal combustion engine 16 can provide torques, by means of which the wheels 14 can be driven via the axle drive 20 and the gearbox 18.

For example, the internal combustion engine 16 has at least one combustion chamber which is partially bounded or formed by a cylinder formed by the housing 22. During a fired operation of the internal combustion engine 16, the internal combustion engine 16 is activated, whereby combustion processes take place in the combustion chamber during the fired operation. By means of these combustion processes, the output shaft 24 is driven and thus rotated around the axis of rotation 26 relative to the housing 22. The internal combustion engine 16 has a flywheel 28 which is formed separately from the output shaft 24 and can rotate with the output shaft 24, which flywheel 28 is formed, for example, as a dual-mass flywheel (ZMS) and can implement a particularly smooth running of the internal combustion engine 16. The flywheel 28 is arranged on an output side 30 of the internal combustion engine 16 or the output shaft 24, whereby the transmission 18 is also arranged on the output side 30.

On a side 32 of the internal combustion engine 16 or of the output shaft 24 opposite the output side 30 in the axial direction of the output shaft 24 and also referred to as the control or front side, a spring 34 is provided which can rotate with the output shaft 24 and is also referred to as a spring element.

If the combustion engine 16, which is initially activated and thus in its fired mode, is deactivated, the combustion processes taking place in the combustion chamber or in the combustion engine 16 as a whole are terminated. Due to its inertia, however, the output shaft 24 continues to rotate for a certain time, such that the output shaft 24 coasts down as a result of the deactivation of the internal combustion engine 16, i.e., passes into a so-called coasting down or engine coasting down. During coasting, the output shaft 24 is not driven, such that the speed of the output shaft 24 is reduced.

The spring 34 is to be tensioned or is tensioned during the run-down of the output shaft 24 resulting from a deactivation of the internal combustion engine 16 by a rotation of the output shaft 24 taking place during the run-down and relative to the housing 22 around the axis of rotation 26, i.e., by rotational energy of the output shaft 24, such that the spring 34, as a result of its tensioning, provides a spring force by means of which, during a start of the internal combustion engine 16 following the deactivation, the output shaft 24 can be set in rotation or is set in rotation relative to the housing 22 around the axis of rotation 26. This can, for example, support or effect the start of the internal combustion engine 16.

The internal combustion engine 16 also has a locking device 36. This is held, for example, at least indirectly, in particular directly, on the housing 22. In particular, the locking device 36 is secured against rotation around the axis of rotation 26 relative to the housing 22. As will be explained in more detail below, the locking device 36 is used to secure the output shaft 24 against rotation relative to the housing 22 around the axis of rotation 26 after the spring 34 has been tensioned and while the spring is tensioned. By securing the output shaft 24 against rotation around the axis of rotation 26 relative to the housing 22 by means of the locking device 36, for example, at least part of the spring 34 is also secured against rotation around the axis of rotation 26 relative to the housing 22.

In order to now be able to implement a particularly advantageous operation of the internal combustion engine 16, the internal combustion engine 16 has a blocking device 38 which is provided in addition to the locking device 36 and, in particular, is designed separately from the locking device 36. The blocking device 38 is, for example, held at least indirectly, in particular directly, on the housing 22. In particular, the blocking device 38 is secured against rotation around the axis of rotation 26 relative to the housing 22. The blocking device 38 can be adjusted or switched between a first blocking state and a first release state.

In the blocked state, at least a first part T1 of the spring element (spring 34) is secured against rotation around the axis of rotation 26 relative to the housing 22 by means of the blocking device 38, for example in such a way that the first part T1 is connected to the housing 22 in a rotationally fixed manner by means of or via the blocking device 38. The spring 34 also has a second part T2, which is spaced from the first part T1 in the axial direction of the output shaft 24 and in the axial direction of the spring 34, the axial direction of which coincides with the axial direction of the output shaft 24. The second part T2 is non-rotatably connected to the output shaft 24 and can thus rotate with the output shaft 24. For example, the parts T1 and T2 are formed integrally with each other. Alternatively or additionally, the parts T1 and T2 form at least one part of at least one spring coil of the spring 34. In the exemplary embodiment shown in the FIGURE, the spring 34 is designed as a torsion or rotation spring. In the first release state, the blocking device 38 releases the part T1 for rotation around the axis of rotation 26 relative to the housing 22. In other words, in the first blocking state, the part T1 cannot be rotated around the axis of rotation 26 relative to the housing 22 as this is prevented by the blocking device 38. However, in the first release state, the part T1 can be rotated around the axis of rotation 26 relative to the housing 22.

The locking device 36 can be switched or adjusted between a second blocking state and a second release state. In the second blocking state, the locking device 36 secures the output shaft 24 against rotation around the axis of rotation 26 relative to the housing 22. Since the part T2 is non-rotatably connected to the output shaft 24, in the second blocked state the part T2 is secured against rotation around the axis of rotation 26 relative to the housing 22 via the output shaft 24 by means of the locking device 36, such that, in the second blocked state, the output shaft 24 and the part T2 cannot rotate around the axis of rotation 26 relative to the housing 22. In the second release state, however, the locking device 36 releases the output shaft 24 and thus the part T2 for rotation around the axis of rotation 26 relative to the housing 22, such that in the second release state the output shaft 24 and with it the part T2 can rotate around the axis of rotation 26 relative to the housing 22. If, for example, the locking device 36 and the blocking device 38 are in their respective release states and the output shaft 24 is driven by combustion processes taking place in the internal combustion engine 16 and thus rotated around the axis of rotation 26 relative to the housing 22, the spring 34, in particular the entire spring 34, can simply rotate with the output shaft 24 around the axis of rotation 26 relative to the housing 22.

However, if, for example, the output shaft 24 and with it the part T2 rotate around the axis of rotation 26 relative to the housing 22 while the blocking device 38 is in its first locking state, the parts T1 and T2 are rotated around the axis of rotation 26 relative to each other. This causes the spring 34 to be tensioned, and thus charged or loaded. This converts rotational energy of the rotating output shaft 24 into spring energy or potential energy, which is stored in the spring 34. If, for example, the locking device 36 is then moved into its second locking state while the blocking device 38 is still in the second locking state and the spring is tensioned, the spring 34 is kept tensioned.

If, for example, the locking device 36 is then moved into its second release state during the aforementioned start, in particular while the locking device 38 is still in its first locking state, the spring 34 can at least partially relax. Thus, the output shaft 24 is accelerated and thus driven by means of the spring 34 or by means of its spring force and thus rotated around the axis of rotation 26 relative to the housing 22, whereby the internal combustion engine 16 is started or can be started. Of course, for example, in particular a short time after the output shaft 24 has been rotated by means of the spring force of the spring 34 in order to start the internal combustion engine 16, the blocking device 38 is also moved into its first release state, such that the output shaft 24 can then be driven by combustion processes taking place in the internal combustion engine 16 and can thus be rotated around the axis of rotation 26 relative to the housing 22 without this being excessively impaired by the spring 34, the locking device 36 or the blocking device 38.

In the exemplary embodiment shown in the FIGURE the spring 34 is arranged at a front end of the output shaft 24 and is non-rotatably connected to the output shaft 24 at the front end, such that the part T2 is non-rotatably connected to the front end.

Furthermore, a blocking element 40 is provided which is formed separately from the spring 34 and is also referred to as a positive locking element, blocking disc or locking disc. In the axial direction of the output shaft 24, the spring 34 is arranged at least partially, in particular at least extensively or completely, between the blocking element and the output shaft 24. In this case, the part T1 is connected to the blocking element 40 in a rotationally fixed manner. The blocking element 40 has recesses 42 on its periphery or across its periphery, in particular evenly distributed recesses 42, which are formed as bores, for example. The blocking device 38 has an actuator 44 and a further blocking element 46, for example in the form of a pin or bolt, which can be moved by means of the actuator 44 in a movement direction illustrated in the FIGURE by a dashed line 48 relative to the blocking element 40, in particular translationally. The movement direction is oblique or perpendicular to the axis of rotation 26. This means, for example, that a first plane perpendicular to the axis of rotation 26 is perpendicular to a second plane perpendicular to the direction of movement. In the first blocking state, the blocking element 46, which is for example in the form of a locking pin, engages in one of the recesses 42, as a result of which the blocking device 38 interacts with the locking element 40 in a form-fitting manner. As a result, the locking element 40 and, via it, the part T1 are secured in a form-fit manner by means of the blocking device 38 against rotation relative to the housing 22 around the axis of rotation 26.

If the internal combustion engine 16, which is initially activated and thus in its fired mode, is deactivated, for example, i.e., switched off, then ignition and injection are switched off, such that fuel is no longer introduced into the combustion chamber of the internal combustion engine 16 and ignitions taking place in the combustion chamber cease. As a result, the output shaft 24 goes into its run-down, such that the rotational speed of the output shaft 24 decreases.

Here, the internal combustion engine 16 has a sensor 50 by means of which, for example, a rotational speed of the output shaft 24 is detected. In particular, a rotational speed of the flywheel 28 and, via this, the rotational speed of the output shaft 24 is detected by means of the sensor 50. The sensor 50 provides, for example, a signal, in particular an electrical signal, which characterizes the rotational speed detected by the sensor 50. An electronic computing device 52 of the internal combustion engine 16 shown particularly schematically in the FIGURE receives, for example, the signal provided by the sensor 50 and characterizing the rotational speed and can then, for example, control the locking device 36 and/or the blocking device 38 as a function of the received signal, such that, for example, the locking device 36 and/or the blocking device 38 can be operated or are operated as a function of the detected rotational speed. In particular, the sensor 50 is designed to detect respective rotational or angular positions of the output shaft 24 or the flywheel 28 and, as a consequence, the rotational speed of the flywheel 28 or the output shaft 24. Since, for example, the flywheel 28 is connected to the output shaft 24 in a rotationally fixed manner, the rotational speed of the flywheel 28 corresponds to the rotational speed of the output shaft 24.

For example, the respective angular or rotational position of the flywheel 28 or the output shaft 24 detected by means of the sensor 50 is compared with a so-called stop map or with data or positions stored in the stop map, whereby the stop map and thus its data or positions are stored in the electronic computing device 52, for example. By comparing the rotational positions detected by means of the sensor 50 with the stored positions, a forecast can be made about a further future course of the rotational speed of the output shaft 24. For example, the locking device 36 and/or the blocking device 38 are operated depending on the forecast.

The flywheel 28 has recesses 54 on its outer periphery, in particular evenly distributed recesses, which can be designed as bores, for example. The locking device 36 has a second actuator 56 and a locking element 58, for example in the form of a bolt. The locking element 58 is formed, for example, as a locking bolt. The locking element 58 can be moved by means of the actuator 56 in a second movement direction relative to the flywheel 28 or relative to the output shaft 24, in particular translationally, as illustrated in the FIGURE by a dotted line 60. The second movement direction runs, for example, obliquely or perpendicularly to the axis of rotation 26, such that, for example, a third plane running perpendicularly to the second movement direction runs perpendicularly to the plane which runs perpendicularly to the axis of rotation 26.

In the first release state, there is no engagement of the blocking element 46 with the or all recesses 42, such that there is no interaction between the blocking element 46 and the blocking element 40. As a result, the blocking device 38 releases the blocking element 40 and thus the part T1 for rotation around the axis of rotation 26 relative to the housing 22.

In the second blocking state, the locking element 58 engages in one of the recesses 54 formed, for example, as bores, such that in the second blocking state the locking device 36 interacts positively with the flywheel 28. As a result, the flywheel 28 and, via the flywheel, the output shaft 24, are positively secured by means of the locking device 36 against rotation around the axis of rotation 26 relative to the housing 22. In the second release state, however, the locking element 58 does not engage in the or all recesses 54 of the flywheel 28, such that in the second release state the locking device 36 releases the flywheel 28 and thus the output shaft 24 for rotation around the axis of rotation 26 relative to the housing 22.

For example, when the output shaft 24 runs out, the sensor 50 detects the respective rotational positions, also referred to as rotational locations, and the rotational speed of the output shaft 24, in particular via the flywheel 28. If the rotational speed of the output shaft 24 has fallen below a predetermined or predeterminable threshold value, for example, which corresponds, for example, to the idling speed of the internal combustion engine 16, the blocking element 46 is triggered. This means that the blocking device 38 is brought out of its first release state into its first blocking state, as a result of which the blocking element 40 and, via the latter, the part T1 are non-rotationally locked, i.e., are secured against rotation around the axis of rotation 26 relative to the housing 22. However, since the locking device 36 is still in its second release state, the output shaft 24 can still rotate, whereby the output shaft 24 is braked by means of the spring 34. In the process, the spring 34 is twisted, i.e., tensioned or charged. In particular, the output shaft 24 is braked during its run-down by means of the spring 34, which is designed as a torsion spring, for example, in such a way that the output shaft 24 comes to a standstill. After the output shaft 24 has come to a standstill, the output shaft 24 is rotated backwards, for example, by means of the then tensioned spring 34 until the output shaft 24 comes to a standstill again. In the second standstill of the output shaft 24, for example, the blocking element 58 is triggered, i.e., the locking device 36 is moved from its second release state into its second blocking state. This locks the output shaft 24, thus securing it against rotation around the axis of rotation 26 relative to the housing 22. The spring 34 is then tensioned and is kept tensioned, in particular in such a way that when the locking device 36 is moved from its blocked state to its second released state, the spring 34 or its spring force causes the output shaft 24 to rotate in the first direction of rotation. Thus, the output shaft 24 is accelerated or rotated for the start in the correct first direction of rotation.

Thus, during fired operation, the output shaft 24 is rotated around the axis of rotation 26 relative to the housing 22 in a first direction of rotation. The output shaft 24 is to be rotated in this first direction of rotation to start the internal combustion engine 16. During its coasting, the output shaft 24 continues to rotate in the first direction of rotation without being driven. Here, the output shaft 24 is braked by means of the spring 34, whereby the spring 34 is tensioned.

After this standstill, the output shaft 24 is rotated back around the axis of rotation 26 relative to the housing 22 by means of the then tensioned spring 34, i.e., rotated in a second direction of rotation opposite to the first directions of rotation, in particular until the output shaft 24 comes to its, in particular second, standstill again. In this second standstill, the spring 34 is tensioned and the locking device 36 is moved from its second release state into its second locking state.

For example, if the blocking member 58 is then retracted such that it no longer engages in the recess 54 such that the locking device 36 is moved to its second release state, the spring 34 can relax. As a result, the output shaft 24 is rotated in the first direction of rotation, whereby a start of the internal combustion engine 16 can be performed, that is, caused or assisted.

For example, for a conventional start, the first cylinder whose piston passes its top dead centre is fired and then all the following cylinders. For a direct start, the cylinder whose piston had already passed its top ignition dead centre at standstill is fired and then all the following cylinders. As soon as the spring 34 has rotated the output shaft 24 during the start in such a way that the spring 34 is released, the locking element 46 is also retracted, i.e., the locking device 38 is moved into its first release state, such that the spring 34 does not hinder the start or an associated start-up of the internal combustion engine 16.

LIST OF REFERENCE CHARACTERS

10 Drivetrain
12 Axis
14 Vehicle wheel
16 Internal combustion engine
18 Transmission
20 Axle transmission
22 Housing
24 Output shaft
26 Axis of rotation
28 Flywheel
30 Output side
32 Side
34 Spring
36 Stopping device
38 Blocking device
40 Blocking element
42 Recess
44 Actuator
46 Blocking element
48 Dashed line
50 Sensor
52 Electronic computing device
54 Recess
56 Actuator
58 Stopping element
60 Dashed line
T1 First part
T2 Second part

The invention claimed is:

1. An internal combustion engine (16) of a motor vehicle, comprising:

an output shaft (24) which is rotatable around an axis of rotation (26) relative to a housing (22) of the internal combustion engine (16), wherein a torque is providable by the internal combustion engine (16) for driving the motor vehicle via the output shaft (24);

a spring element (34) which is rotatable with the output shaft (24), wherein the spring element (34) is tensionable as a result of a deactivation of the internal combustion engine (16) by rotation of the output shaft (24) relative to the housing (22) around the axis of rotation (26), wherein a spring force is providable by the spring element (34) by tensioning the spring element (34), wherein the output shaft (24) is settable in rotation relative to the housing (22) around the axis of rotation (26) during a start of the internal combustion engine (16) following the deactivation by the spring force, and wherein the spring element (34) has a first part (T1) and has a second part (T2) that is non-rotationally connected to the output shaft (24);

a locking device (36), wherein the output shaft (24) is securable against rotation relative to the housing (22) around the axis of rotation (26) after the spring element (34) has been tensioned and while the spring element (34) is tensioned by the locking device (36);

a blocking device (38), wherein the blocking device (38) is adjustable between a first blocking state securing the first part (T1) of the spring element (34) against a rotation taking place relative to the housing (22) around the axis of rotation (26) and a first release state releasing the first part (T1) for a rotation taking place relative to the housing (22) around the axis of rotation (26);

a blocking element (40), wherein the blocking element (40) is formed separately from the spring element (34) and is non-rotationally connected to the first part (T1) of the spring element (34) and interacts in the blocked state with the blocking device (38), wherein the blocking element (40) and, via the blocking element (40), the first part (T1) of the spring element (34) are securable against a rotation taking place in relation to the housing (22) around the axis of rotation (26);

wherein the locking device (36) is movable between a second blocking state securing the output shaft (24) against rotation taking place in relation to the housing (22) around the axis of rotation (26) and a second release state releasing the output shaft (24) for rotation taking place in relation to the housing (22) around the axis of rotation (26); and a flywheel (28) formed separately from the output shaft (24), wherein the flywheel (28) is rotatable together with the output shaft (24) and wherein the locking device (36) cooperates in a form-fit manner with the flywheel (28) in the second blocking state;

wherein the flywheel (28) and the blocking element (40) are disposed on respective sides (30, 32) of the output shaft (24) which are opposite one another in an axial direction of the output shaft (24).

2. The internal combustion engine (16) according to claim 1, wherein the blocking device (38) in the first blocking state interacts in a form-fit manner with the blocking element (40).

3. The internal combustion engine (16) according to claim 1, further comprising a sensor (50), wherein a rotational speed of the output shaft (24) is detectable by the sensor (50), wherein an electrical signal characterizing a detected rotational speed is providable by the sensor (50), and wherein the blocking device (38) and/or the locking device (36) are drivable depending on the electrical signal.

* * * * *